US005894833A

United States Patent [19]

Kikuchi et al.

[11] Patent Number: 5,894,833

[45] Date of Patent: Apr. 20, 1999

[54] INTERNAL COMBUSTION ENGINE

[75] Inventors: Satoru Kikuchi, Fussa; Isamu Sekizawa, Iwate-ken, both of Japan

[73] Assignee: Kioritz Corporation, Oume, Japan

[21] Appl. No.: 09/064,308

[22] Filed: Apr. 23, 1998

[30] Foreign Application Priority Data

Apr. 30, 1997 [JP] Japan ..... 9-112408

[51] Int. Cl.[6] ..... F02M 37/04

[52] U.S. Cl. ..... 123/516; 123/514; 123/517

[58] Field of Search ..... 123/517, 516, 123/518, 514

[56] References Cited

U.S. PATENT DOCUMENTS

| | | | |
|---|---|---|---|
| 1,909,390 | 5/1933 | Ball | 123/516 |
| 3,610,221 | 10/1971 | Stoltman | 123/518 |
| 4,305,368 | 12/1981 | Phelan | 123/516 |
| 4,416,108 | 11/1983 | Ghandhi | 123/516 |

FOREIGN PATENT DOCUMENTS

| | | | |
|---|---|---|---|
| 1916565 | 10/1970 | Germany | 123/517 |
| 0041724 | 3/1977 | Japan | 123/517 |
| 5-33727 | 8/1993 | Japan . | |
| 1617176 | 12/1990 | U.S.S.R. | 123/517 |

*Primary Examiner*—Carl S. Miller
*Attorney, Agent, or Firm*—Thelen, Reid & Priest, LLP

[57] ABSTRACT

The object of the present invention is to provide an internal combustion engine for solving the problem of fuel leakage through an air vent of an carburetor.

An internal combustion engine comprises a fuel tank; a carburetor having an air vent at a location above the fuel tank; a fuel circulation passage for supplying fuel from the fuel tank to the carburetor on a upstream side thereof and returns oversupplied fuel to the fuel tank on a downstream side thereof; and a fuel capturing chamber communicated with the air vent, the fuel capturing chamber having an air bleeder so that the fuel which flows backward from the fuel tank through the downstream side of the fuel circulation passage and leaks through the air vent is captured in the fuel capturing chamber.

2 Claims, 5 Drawing Sheets

INTERNAL COMBUSTION ENGINE

BACKGROUND OF THE INVENTION

The present invention relates to an internal combustion engine including a compact air-cooled type two-stroke cycle gasoline engine which is mounted on a back pack type working apparatus, etc., in particular, to an internal combustion engine having a circulation-type carburetor.

DESCRIPTION OF THE PRIOR ART

Conventionally, a working apparatus driven by an internal combustion engine such as a portable trimmer, a chemical sprayer, a power blower or the like, is known, and some of the engines are equipped with a circulation-type carburetor.

A structure of a conventional circulation-type carburetor 2 will now be described with reference to FIG. 5. A fuel tank 4 is provided below the carburetor 2. The carburetor 2 has a fuel circulation passage through which fuel stored in the fuel tank 4 is supplied to a fuel chamber 22 disposed above the fuel tank 4 via a suction pipe 6. Oversupplied fuel is returned to the fuel tank 4 via a return pipe 8.

The operation of the carburetor 2 will now be described. For example, prior to starting an internal combustion engine such as a compact air-cooled type two-stroke cycle gasoline engine(not illustrated), first, by pressing and releasing a bulb 10 of a priming pump installed in the carburetor 2 by hand, negative pressure is generated inside a pump chamber 12 of the bulb 10. It causes a suction check valve 14 to open and a discharge check valve 16 to close, whereby the negative pressure is generated in a diaphragm chamber 18 defined by a diaphragm 20 disposed between the suction check valve 14 and the discharge check valve 16. As a result, the fuel in the fuel tank 4 flows through the suction pipe 6 and the suction check valve 14 and into the pump chamber 12. Subsequently, by pressing the bulb 10 again, the pressure inside the pump chamber 12 becomes positive to cause the suction check valve 14 to close and the discharge check valve 16 to open, whereby the fuel which fills the pump chamber 12 is delivered to the diaphragm chamber 18 and further into the fuel chamber 22. The operation of pressing and releasing of the bulb 10 is repeated several times until the fuel chamber 22 is filled with the fuel.

Then, when the internal combustion is started, the pressure pulse (pulsating pressure between positive and negative) inside a crank chamber(not illustrated) acts on the back side of the diaphragm 20, whereby the pressure inside the diaphragm chamber 18 varies. The fuel inside the fuel tank 4 is continuously delivered through the suction pipe 6 to the fuel chamber 22 by the continuous pulses applied by the diaphragm 20. Further, the fuel supplied to the fuel chamber 22 is measured by a main jet 26 and is sucked out of a needle jet 28. Then, it is transformed into an air-fuel mixture and is sucked into a cylinder of the engine. The fuel which is excessively supplied to the fuel chamber 22 due to the continuous supply thereof overflows a gate 29 and returns to the fuel tank 4 via the return pipe 8. An air cleaner 32 is provided on the air suction side of a venturi portion 30 of the carburetor 2.

An air vent 23 communicates with the fuel tank 4 through the return pipe 8 on the downstream side of the fuel circulation passage, that is, the fuel returning side. Therefore, when the mixture of vaporized fuel and air in the upper space of the fuel tank 4 is heated to cause it to expand, for example, under extremely high temperature during the summer time, the pressure in the tank 4 is still kept at the atmospheric pressure since the fuel tank 4 ventilates through the air vent 23.

When an operator carries the portable working apparatus having the internal combustion engine on his back, it is oriented in various positions, for example, from an upright position to an inclined position. In such a case, the fuel level in the fuel tank 4 moves with respect to the fuel tank 4 from the position shown in a solid line to that represented in a dotted line in FIG. 5. It may cause the lower end portion of the return pipe 8 to be closed. In such a case, if the air and vaporized fuel in the space within the fuel tank 4 is heated and is expanded as described above, it can cause the fuel to leak out of the air vent 23.

The object of the present invention is to provide an internal combustion engine for effectively solving the problem of fuel leakage through an air vent while meeting the overall dimensions and design restrictions of the existing device.

SUMMARY OF THE INVENTION

The object of the present invention is accomplished by an internal combustion engine which comprises a fuel tank; a carburetor having an air vent at a location above the fuel tank; a fuel circulation passage for supplying fuel from the fuel tank to the carburetor on a upstream side thereof and returns oversupplied fuel to the fuel tank on a downstream side thereof; and a fuel capturing chamber communicated with the air vent, the fuel capturing chamber having an air bleeder so that the fuel which flows backward from the fuel tank through the downstream side of the fuel circulation passage and leaks through the air vent is captured in the fuel capturing chamber.

In the present invention, when the engine takes an upright position, the fuel circulation passage and the fuel tank communicate with the atmosphere via the air vent, the fuel capturing chamber, and further the air bleeder. On the other hand, when the engine is inclined to cause the downstream side of the return pipe of the fuel circulation passage to be closed by the fuel within the fuel tank, the fuel therein is pumped out therethrough by the expansion of the air and/or vaporized fuel in the fuel tank. As a result, it may leak through the air vent. In such a case, the fuel which leaked out of the air vent flows into the fuel capturing chamber and captured therein. Therefore, it prevents to stain an operator's clothes with the leaked fuel or spill it over agricultural products.

According to an aspect of the present invention, the fuel capturing chamber is provided with an inlet which communicates with the air vent, and the inlet is located at a lower portion of the fuel capturing chamber and above the air vent.

When the internal combustion engine is oriented so as to take the upright position and the fuel circulation passage is no longer closed by the fuel, the fuel captured in the fuel capturing chamber flows toward the air vent disposed below the inlet by gravity and returns to the fuel tank through the fuel circulation passage. Thus, a complete fuel circulation system for the carburetor is established.

DESCRIPTION OF THE PREFERRED EMBODIMENTS

A preferred embodiment of the present invention shall be described with reference to the attached drawings hereinafter.

Figure 1:
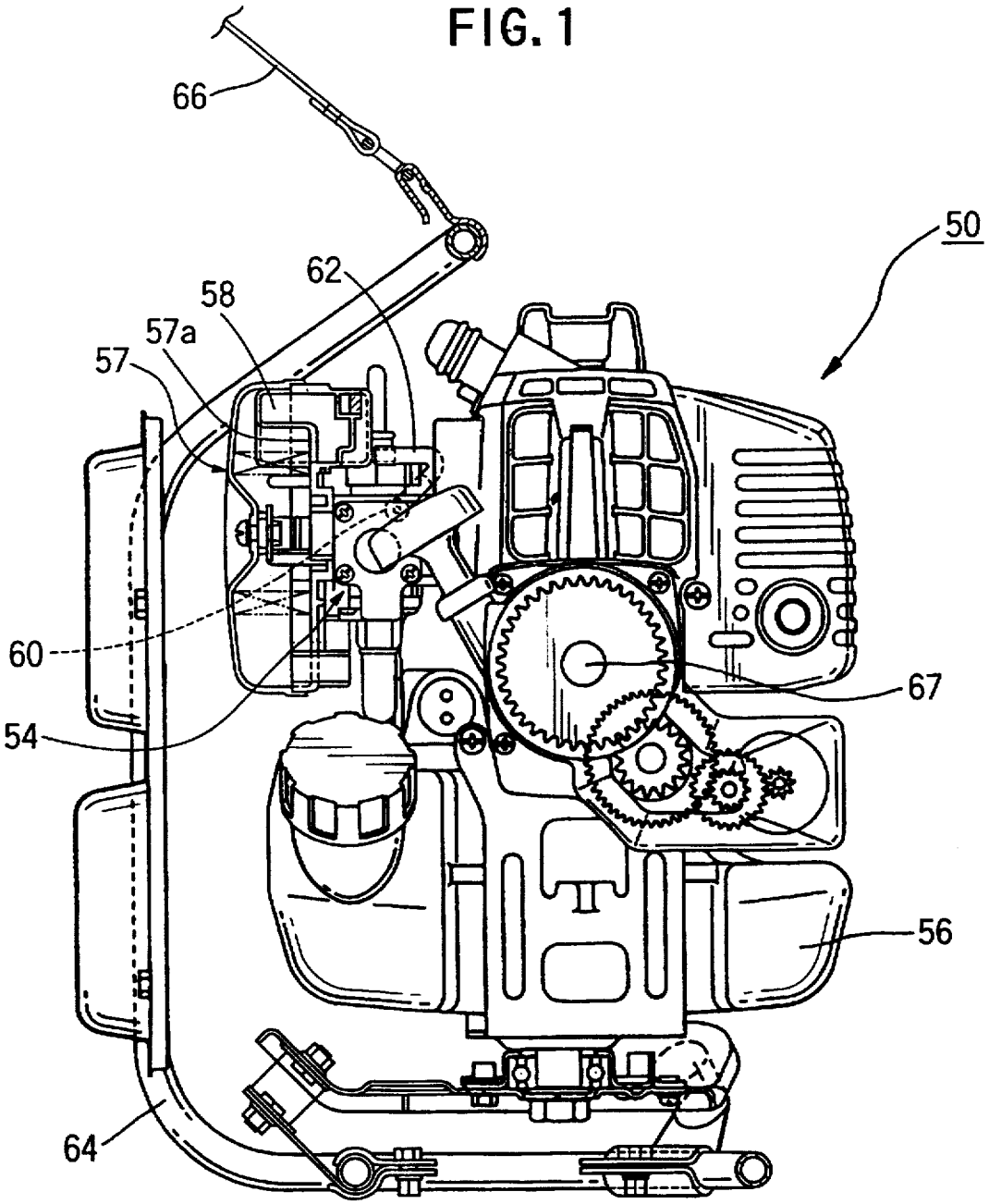
FIG. 1 is a partial cross-sectional side view of a backpack type working apparatus having an internal combustion engine of the present embodiment mounted thereon which illustrates a main part thereof.

An internal combustion engine 50 mounted on a backpack type working apparatus shown in FIG. 1, for example, is an air-cooled type two-stroke cycle gasoline engine with a displacement of about 25 cc. It comprises a carburetor 54 having substantially the same structure with that of a conventional circulation-type carburetor 2 shown in FIG. 5, a fuel tank 56 disposed below the carburetor 54, an air cleaner 57 disposed on one side of the carburetor 54, and a fuel capturing chamber 58 separated from the air cleaner 57 by an upper wall of the air cleaner case body 57*a* and defines an upper space of the air cleaner 57. The fuel capturing chamber 58 communicates with an air vent 60 of the carburetor 54 via a pipe 62. The entire internal combustion engine 50 is mounted on a backpack frame 64 and an operator carries the backpack frame 64 on his back with straps 66 on his shoulder. There are various kinds of back pack type working apparatuses, for example, a portable trimmer, a chemical sprayer, a power blower or the like. Among those, for example, in the case of the portable trimmer, an output shaft connected to a rotating cutter is rotatably driven by a drive shaft 67 of the engine 52.

Figure 5:
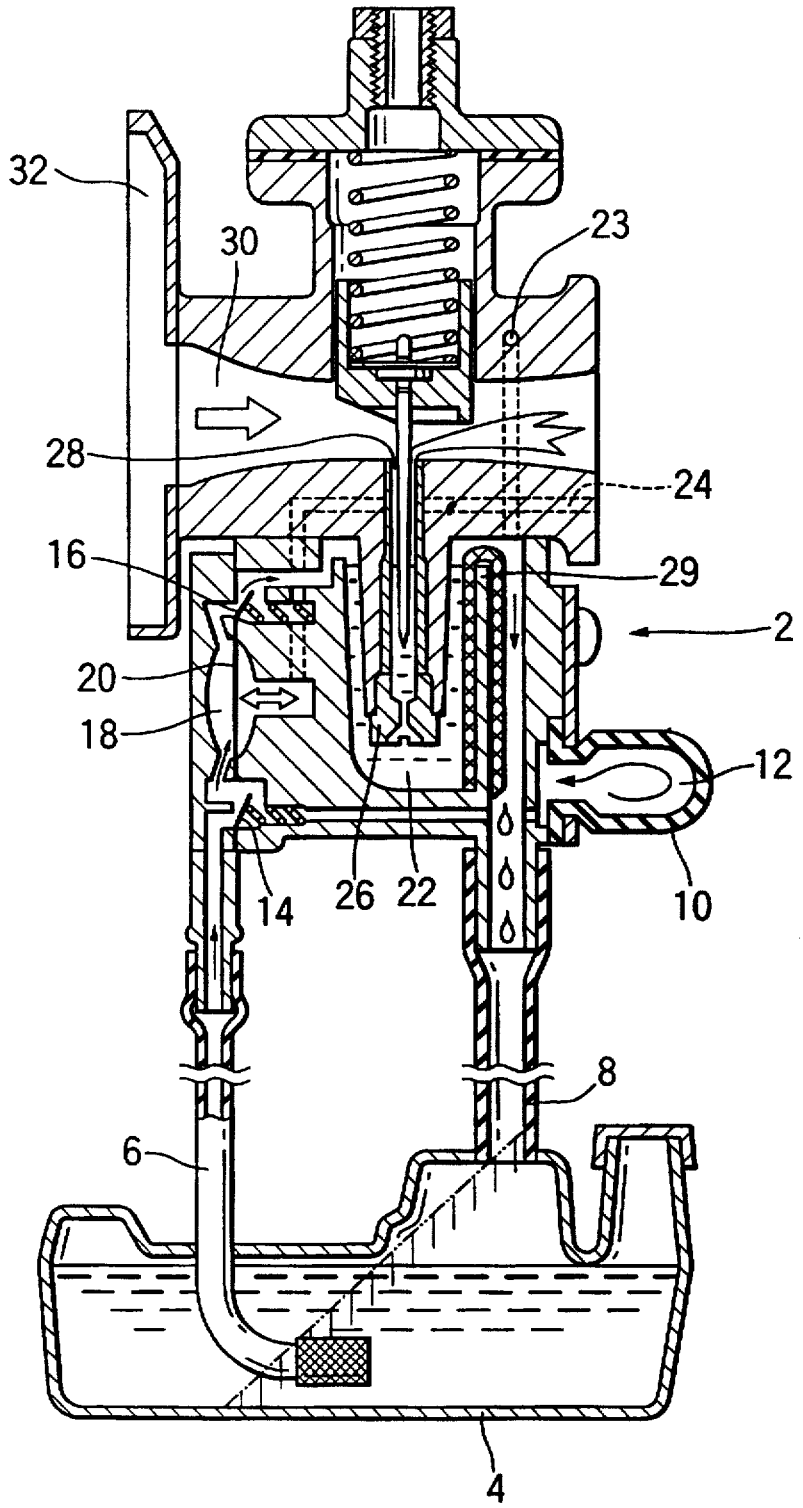
FIG. 5 (PRIOR ART)
FIG. 5 is a schematic longitudinal sectional view of a typical conventional circulation-type carburetor.

Since the carburetor 54, the fuel tank 56, the air cleaner 57, and the air vent 60 of the present embodiment have the same structures and functions as the carburetor 2, the fuel tank 4, the air cleaner 32, and the air vent 23, respectively, of the conventional type shown in FIG. 5, their descriptions are omitted to avoid repeated explanations. Similarly, the present embodiment has a similar fuel circulation passage as the suction pipe 6, the fuel chamber 22, and the return pipe 8 of a conventional one. Therefore, the description on the fuel circulation passage of the present embodiment shall also be omitted. The same elements as the conventional fuel circulation passage shall be indicated by the same reference numerals and explanation therefor shall be also omitted since is has been already described hereinbefore.

Figure 2:
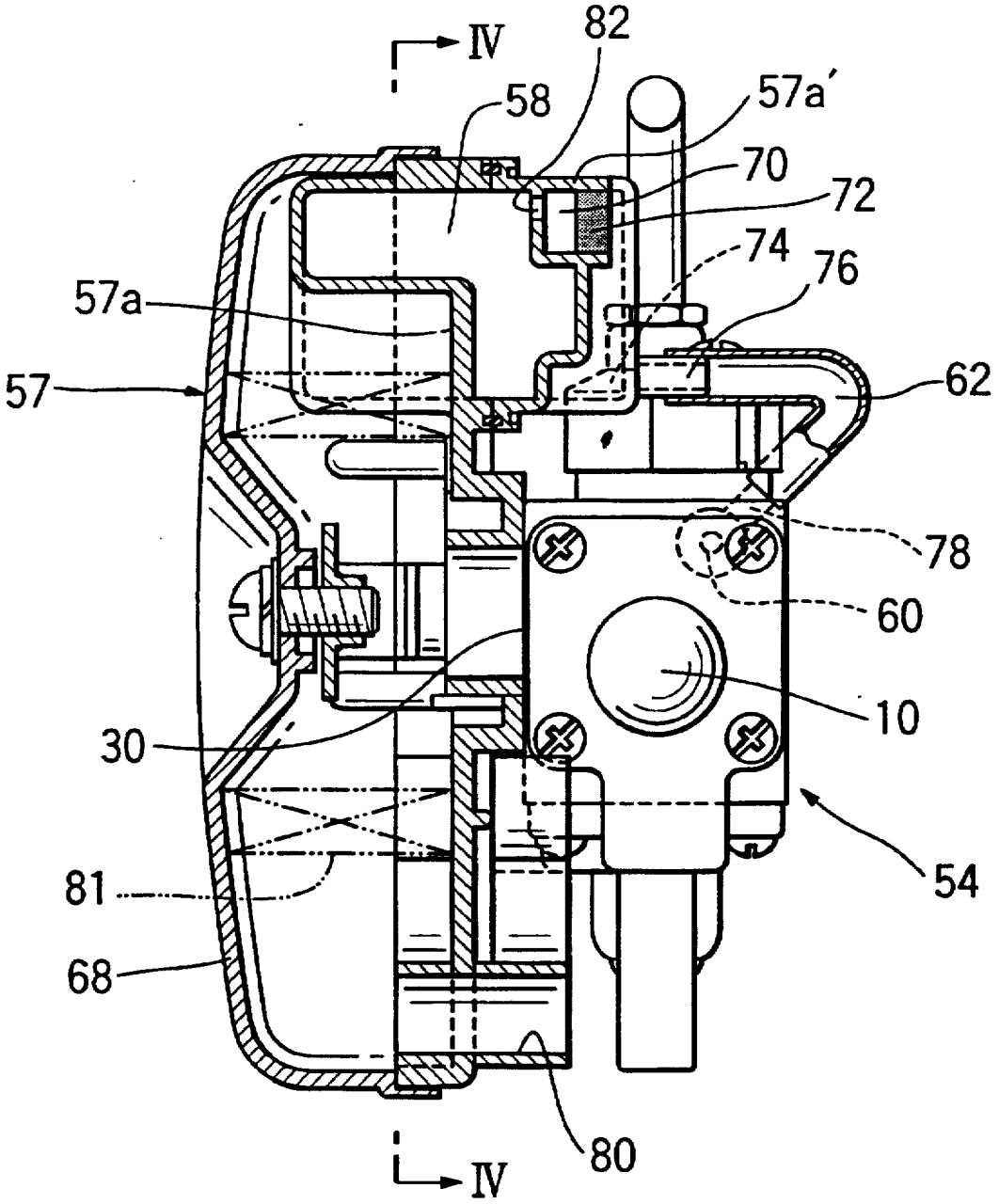
FIG. 2 is an enlarged longitudinal sectional view illustrating communicational relationship among an air cleaner, a fuel capturing chamber, and an air vent shown in FIG. 1.
Figure 3:
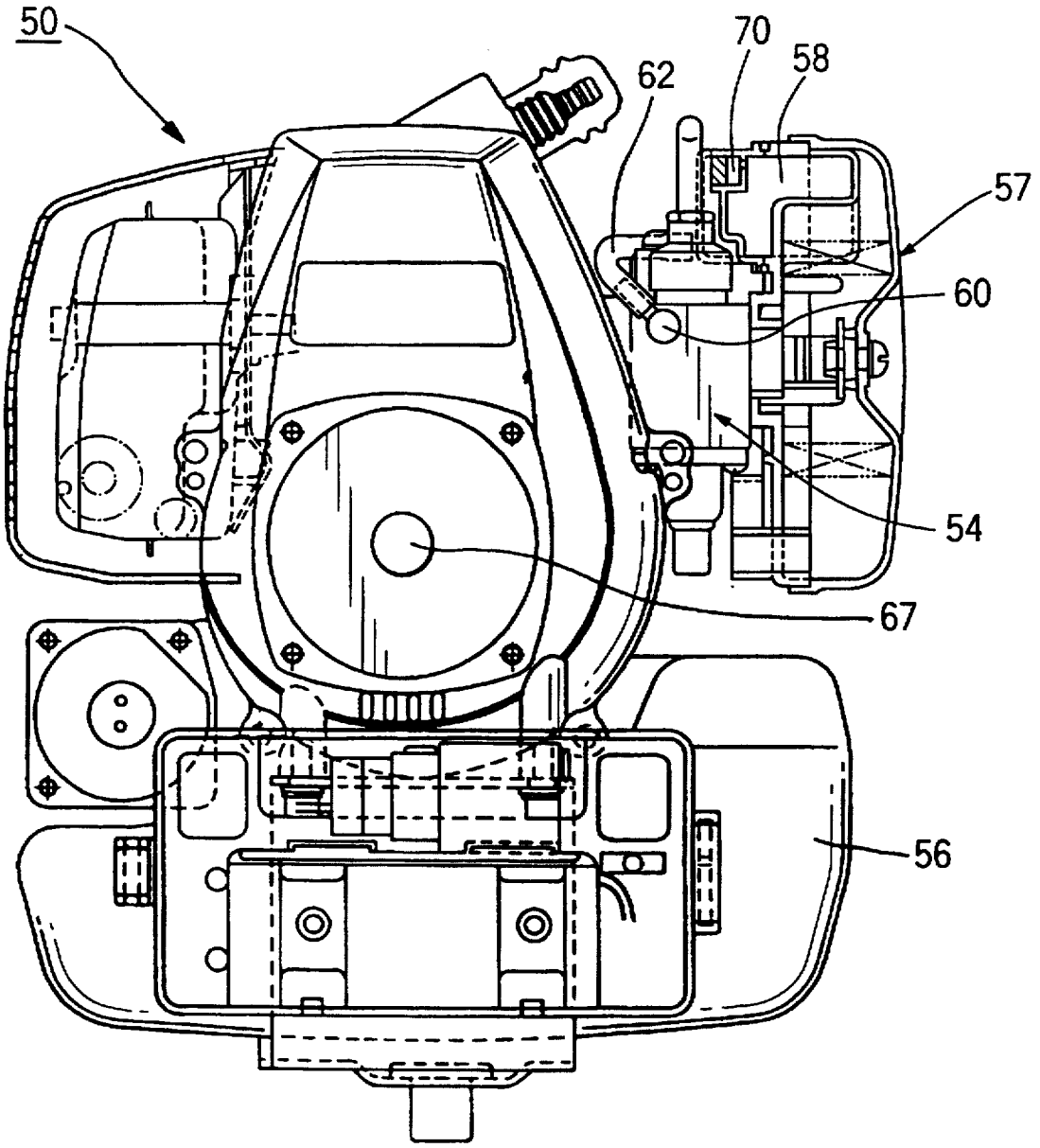
FIG. 3 is a partial cross-sectional back view of the internal combustion engine shown in FIG. 1 illustrating a main part thereof.
Figure 4:
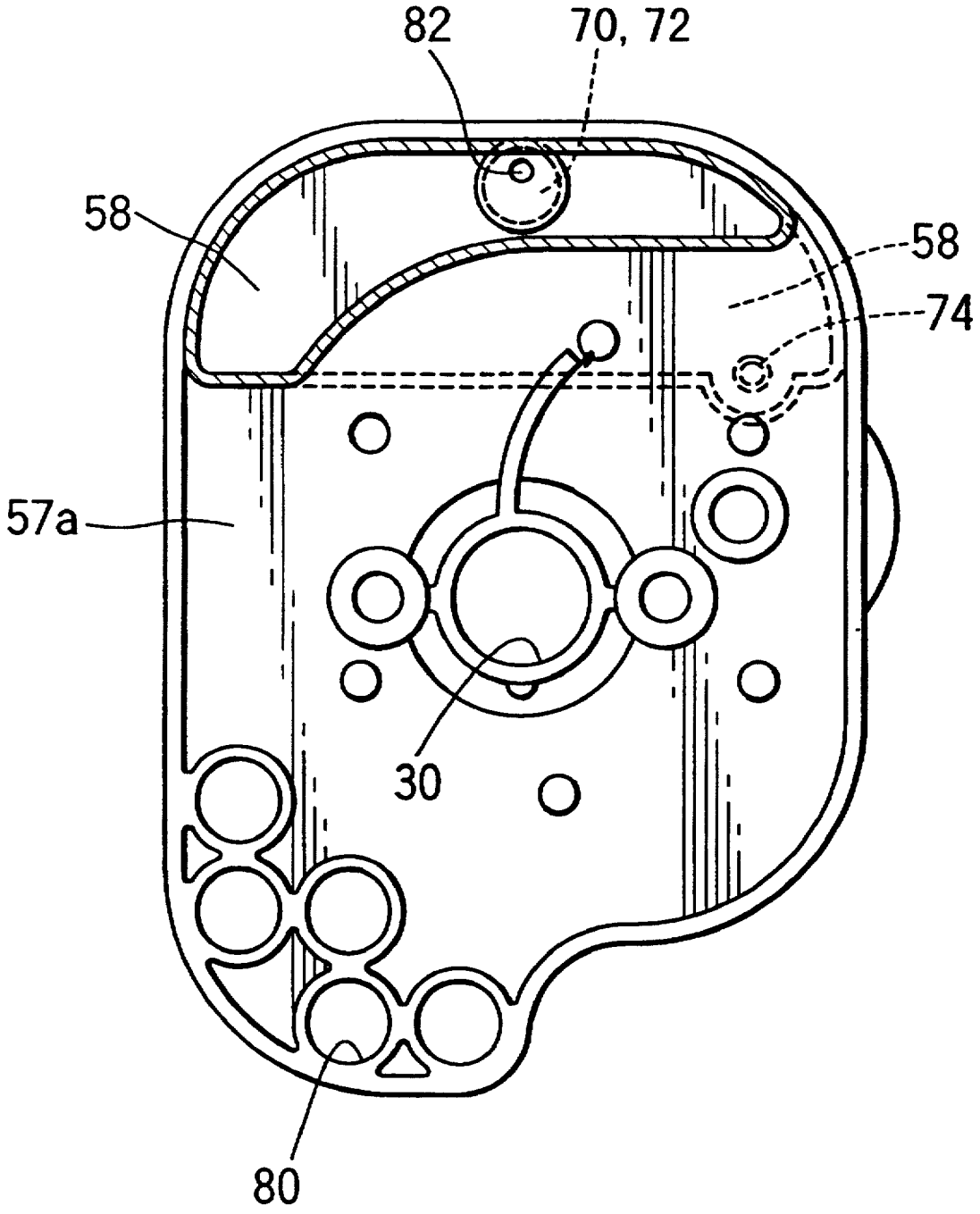
FIG. 4 is a partial cross-sectional view taken along the line IV—IV and viewed in the direction of the arrows shown in FIG. 2.

With reference to FIGS. 2 to 4, describing about the fuel capturing chamber 58 in more detail, it is a space to temporarily store the fuel which flows backward from the fuel tank 56 through the return pipe 8 or a down stream side of the fuel circulation passage(see FIG. 5) and leaks through the air vent 60 due to expansion of the vaporized fuel and air within the fuel tank 56, for example, due to the temperature rise of outside air. To meet a demand which is to reduce the size of a backpack type working apparatus, the fuel capturing chamber 58 is provided in an upper inner space of the air cleaner 57 which is defined by an air cleaner cover 68 and the air cleaner case body 57*a* as shown in FIG. 2. The fuel capturing chamber 58, as shown in FIG. 4, is shaped to form a concave portion to avoid interference with other components including cylindrical filter element 81. The fuel leakage caused by the ordinary temperature rise in the internal combustion engine 50 of the present embodiment is estimated to be 30 cc at the maximum. Accordingly, the fuel capturing chamber 58 of the present embodiment has a volume of 35cc allowing some margin. An air bleeder 70 is defined by a depressed portion at an upper end portion 57*a'* of the outer side wall which is the exposed outer wall of the air cleaner case body 57*a* which defines the fuel capturing chamber 58. To prevent the air bleeder 70 from being clogged with dust and dirt, a hole 82 is formed horizontally at an upper end portion of the depressed portion. The hole 82 has a minimum size possible which shall not be clogged with a fuel droplet. Further, in order to prevent the dust from entering into the fuel capturing chamber 58, a filter 72 is installed in the air bleeder 70 slightly outside of the small hole 82 to improve ventilation. At the lower end portion of the outer side wall 57*a'* of the fuel capturing chamber 58, a fuel inlet 74 is provided so as to lead the fuel to the fuel capturing chamber 58. A pipe connector 76 projects horizontally and outwardly. A pipe 62 is connected thereto at one end. As can be understood with reference to FIG. 2, the air vent 60 of the carburetor 54 is located below the fuel inlet 74. A pipe connector 78 protrudes upwardly from the air vent 60. The pipe 62 is connected thereto at the other end, whereby the air vent 60 and the fuel inlet 74 communicate with each other.

The function of the fuel capturing chamber 58 will now be described. First, when the internal combustion engine 50 takes the upright position, the air and vaporized fuel which are stored in the upper space above the fuel surface within the fuel tank 56 are heated to cause them to expand, for example, by the temperature rise of the outside air during the summer, the air and vaporized fuel are ventilated through the return pipe 8, the air vent 60, the pipe 62, the fuel inlet 74, the fuel capturing chamber 58, and finally the air bleeder 70. The ventilation of the fuel chamber 22 (see FIG. 5) is accomplished in the same manner.

On the other hand, when the internal combustion engine 50 is inclined with respect to the upright position, the level of the fuel in the fuel tank 56 may reach the lower end portion of the return pipe 8 of the carburetor 54. As a result, the return pipe may be closed by the fuel. In such a case, the air and vaporized fuel within the fuel tank 56 which is trapped behind the fuel in the fuel tank 56 expand, for example, by the temperature rise of the outside air during summer time, the pressure inside the fuel tank 56 rises. As a result, the fuel is ejected through the return pipe 8 and out of the air vent 60. In the internal combustion engine 50 of the present embodiment, however, the fuel leaked out of the air vent 60 flows through the pipe 62 and the fuel inlet 74 and further into the fuel capturing chamber 58 and is captured therein. The air in the fuel capturing chamber 58 bleeds out through the air bleeder 70 located at an upper potion of the fuel capturing chamber 58. Once the air of the volume equivalent to the expansion of the air and vaporized fuel has been escaped through the air vent 60, the pressure in the fuel tank 56 goes down to the atmospheric pressure and no more fuel leaks out. During this time, the air forced out of the fuel chamber 22 passes through the air vent 60, the pipe 62 and the fuel inlet 74, and further passes through the fuel captured in the fuel capturing chamber 58 in the form of bubbles. It is finally discharged to the atmosphere through the air bleeder 70. In this manner, the function as the air vent is secured.

When the internal combustion engine 50 is oriented in the upright position and the lower end portion of the return pipe 8 is no longer closed by the fuel in the fuel tank 56, the fuel captured in the fuel capturing chamber 58 begins to flow out through the fuel inlet 74 by its own weight, or is sucked by a negative pressure generated within the fuel tank 4 by the running engine 50. As a result, the fuel flows out through the fuel inlet 74, and is returned to the fuel tank 56 through the return pipe 8 by itself.

In the embodiment, since the fuel inlet 74 is disposed above the air vent 60, when the return pipe 8 is not closed, the fuel flows from the fuel inlet 74 to the air vent 60 by its own weight, and is allowed to return to the fuel tank 56 through the return pipe 8. In this manner, a complete circulation of the fuel is established.

Further, in the embodiment, since the fuel inlet 74 is provided in the lowest position of the outer side wall 57*a'* of the fuel capturing chamber 58, the entire fuel captured in the fuel capturing chamber 58 may be discharged by its own weight.

Further, in the embodiment, since the fuel capturing chamber 58 is arranged in an existing inner space of the air cleaner 57, the problem of the fuel leakage can be solved while meeting various design restrictions such as maintaining the dimensions and structure of the existing internal combustion engine 50.

Further, since the air bleeder 70 is arranged at the upper end portion of outer side wall 57*a'* of the fuel capturing chamber 58, the air bleeder 70 will not be closed except in an extraordinary case where the fuel capturing chamber 58 is completely filled with fuel. Therefore the fuel chamber 22 and the fuel tank 56 are properly ventilated, and thereby the substantial function of air vent is secured.

The present invention has thus been shown and described with reference to specific embodiments. However, it should be noted that the present invention is in no way limited to the details of the described arrangements but changes and modifications may be made without departing from the scope of the appended claims.

In the embodiment, for example, the volume of the fuel capturing chamber 58 is 35 cc. However, the volume may be determined based on the amount of the fuel leakage which may differ depending on various conditions such as the orientation of the internal combustion engine during use, the temperature change, etc.

Further, the fuel capturing chamber 58 and the air vent 60 do not need to communicate with each other through the pipe 62. In the case where design restrictions regarding the inner space is not as tight, the fuel capturing chamber 58 may be provided above the air vent 60 and both may be directly connected to each other.

Further, in the embodiment, the fuel capturing chamber 58 is defined in the inner space of the existing air cleaner 57. However, it may be arranged in other space of an internal combustion engine so long as the fuel inlet 74 is disposed above the air vent 60.

Further, in the above embodiment, a case where the air vent 60 which directly communicates with the return pipe 8 arranged on the downstream side of the fuel circulation passage (fuel returning side) has been described. However, the air vent 60 may be applied to another air vent which is arranged in another fuel circulation passage from which fuel may leak out due to a fuel backflow.

We claim:

1. An internal combustion engine, comprising:

a fuel tank;

a carburetor, said carburetor having an air vent at a location above said fuel tank;

a fuel circulation passage for supplying fuel from said fuel tank to said carburetor on an upstream side thereof and returning oversupplied fuel to said fuel tank on a downstream side thereof;

an air cleaner having an inner space;and fuel capturing chamber provided in said inner space of said air cleaner, said fuel capturing chamber being communicated with said air vent, said fuel capturing chamber having an air bleeder at an upper part thereof so that the fuel which flows backward from said fuel tank through said downstream side of said fuel circulation passage and leaks through said air vent is captured in said fuel capturing chamber.

2. An internal combustion engine in accordance with claim 1, wherein said fuel capturing chamber is provided with an inlet which communicates with said air vent, and said inlet is located at a lowest portion of said fuel capturing chamber and above said air vent.

* * * * *